US005188404A

United States Patent [19]

Orendorff

[11] Patent Number: 5,188,404

[45] Date of Patent: Feb. 23, 1993

[54] LOCK BOLT WITH A WARPED CONTACT SURFACE

[75] Inventor: Gary R. Orendorff, Beaverton, Oreg.

[73] Assignee: W.S.A., Inc., Bloomington, Minn.

[21] Appl. No.: 864,123

[22] Filed: Apr. 6, 1992

Related U.S. Application Data

[63] Continuation of Ser. No. 678,528, Mar. 28, 1991, abandoned.

[51] Int. Cl.[5] ..... E05C 1/08

[52] U.S. Cl. ..... 292/194; 292/201; 292/198

[58] Field of Search ..... 292/341.15, 341.17, 292/197, 198, 210, 78, 240, 201, 341.16, 194

[56] References Cited

U.S. PATENT DOCUMENTS

| | | | |
|---|---|---|---|
| 176,887 | 5/1876 | Peer | 292/78 |
| 2,848,263 | 8/1958 | Miller | 292/216 |
| 3,087,749 | 4/1963 | Capton | 292/216 |
| 3,279,837 | 12/1966 | Stoppenbach | 292/223 |
| 3,811,719 | 5/1974 | McBurme et al. | 292/341.17 |
| 3,861,727 | 1/1975 | Froerup et al. | 292/341.16 |
| 3,910,617 | 10/1975 | Scalza et al. | 292/341.16 |
| 4,056,276 | 11/1977 | Jarvis | 292/198 |
| 4,216,986 | 8/1980 | McNinch et al. | 292/341.17 |
| 4,237,711 | 12/1980 | Kambic | 70/432 |
| 4,881,766 | 11/1989 | Schmidt et al. | 292/201 |

FOREIGN PATENT DOCUMENTS

| | | | |
|---|---|---|---|
| 745236 | 5/1933 | France | 292/341.17 |

OTHER PUBLICATIONS

R. R. Brink Locking Systems Model 3020 Technical Information 6 pages, Jul. 1983.

R. R. Brink Locking Systems 1000 Series High Security Mortise Locks.

*Primary Examiner*—Eric K. Nicholson

*Attorney, Agent, or Firm*—Klarquist, Sparkman, Campbell, Leigh & Whinston

[57] ABSTRACT

A lock bolt designed to mount in a door jamb, and designed for use in applications such as penal institutions. The lock bolt has two warped surfaces that are exposed to a closing door. The door contacts the first warped surface along a length of that surface, forcing the lock bolt back into a housing. The two warped surfaces are designed such that the door never contacts the second surface. Therefore, the design allows for greater protrusion and greater width of the lock bolt.

9 Claims, 1 Drawing Sheet

LOCK BOLT WITH A WARPED CONTACT SURFACE

This application is a continuation of application Ser. No. 07/678,528, filed on Mar. 28, 1991 now abandoned.

BACKGROUND OF THE INVENTION

The present invention relates to a door lock for mounting in a mortise formed in a door jamb or door frame. More specifically, the present invention relates to a pivoting lock bolt for use with a jamb mounted lock. Jamb mounted locks of this kind are typically used to secure doors such as those found in penal institutions, as well as in other applications.

Locks that are designed to mount in door jambs typically utilize a lock bolt that pivots about a shaft and rotates back into its housing as the door is closed. This type of a lock bolt is typically called a "swing bolt." As a result of this pivoting action swing bolts require less mounting depth than standard "linear" bolts, which traverse straight back into their housings against a compression spring. Linear bolts typically require up to six inches of mounting depth to provide the bolt with enough throw to secure the door. To obtain this much throw linear bolts are typically mounted in the door itself. The strike plate and the receiving hole are located in the door jamb. This provides the necessary linear space to obtain the needed throw. Such linear bolts are typically used in residential and commercial applications.

However, in many applications it is desirable to mount the lock in the jamb rather than the door. This is especially true in penal institutions because the doors in these facilities are remotely actuated. Since remote actuation requires wires, conduit, and sometimes pneumatic tubes, if the lock were mounted in the door wires and conduit would be exposed when the door was open. This would present an unacceptable security risk. Moreover, use of a linear bolt in these applications requires a great deal of jamb depth to obtain enough throw on the bolt to adequately secure the door. Since the width of the door is fixed, this necessitates enlargement of the opening in the masonry wall to accommodate the wider jamb. In a penal institution, where the walls are generally concrete and the jambs are metal, such an enlargement adds significantly to the cost. Linear bolts are therefore often unacceptable in such applications.

On the other hand, because swing bolts rotate back into their housings by pivoting about a shaft, they require relatively little mounting depth compared to linear bolts. Thus, a swing bolt type lock may be mounted in a relatively small mortise formed in a narrow door jamb; the strike plate and the bolt receiving hole are located in the door. This eliminates the need for special frame preparation or for having an exceptionally large opening in the masonry wall to accommodate an exceptionally deep frame or jamb. Thus, jamb mounted locks utilizing swing bolts may be used in applications where there are constraints on the amount of space available, and also where it is economically advantageous to minimize the amount of building materials used in constructing the door frame.

In addition to the desirably shallow jamb mounting depth that swing bolts allow, another desireable feature in such a locking mechanism is that it have a narrow cross-sectional width. By reducing the width of the lock housing the width of the jamb or frame may be reduced accordingly since the mortise in which the lock mechanism is mounted may be relatively narrow. This reduces material costs and saves space. However, the width of the lock housing is limited somewhat by the relatively large width required for the swing bolt itself. With a swing bolt the angle of incidence between the door edge and the face of the swing bolt that the door edge strikes is critical. The angle of incidence must be steep enough to allow the force of the closing door to drive the swing bolt back into its housing.

Furthermore, in applications such as penal institutions it is especially necessary for the bolt to protrude as much as possible from the jamb to properly engage the receiving plate on the door. The further that the bolt protrudes from the jamb, the further the bolt will engage the receiving hole in the door, and the engagement of the door will be made more secure. It also increases tamper resistance. The need for as much protruding length as possible, when combined with the constraints on the width of the swing bolt, may result in a bolt which has too flat a bevel angle on the face of the bolt, relative to the door, to be driven back into the lock housing by the door when it is closed. The shape of the swing bolt is therefore critical to its efficient operation.

One solution to this problem has been to increase the cross-sectional depth of the bolt in order to increase the bevel angle on the face of the bolt relative to the door. This increases the angle of incidence between the door and the back of the bolt, and allows the door to drive the bolt back into its housing as the door is closed. But this solution also increases the width of the lock body and therefore the required dimensions of the door jamb. This increases the cost of manufacturing the lock and of the materials used in the door and frame.

Another solution to the problem of the bevel angle being too flat is to decrease the distance that the bolt protrudes from the lock body. This allows for a steeper bevel angle on the face of the bolt, allowing it to be driven back into the lock body as the door is closed. However, this solution is not satisfactory because assembly tolerances between the door and jamb, known in the industry as the reveal, allows enough variation that a swing bolt with a relatively short protrusion may not engage the receiving plate far enough to hold the door closed securely. This is especially important in penal institutions where maximum security and tamper resistance is desired. In addition, in the event of a fire the reveal may be increased due to warping of the door caused by the intense heat. If the bolt has a relatively short throw such that it engages the door only a short distance, the warping caused by the heat may be enough to cause the door to open inadvertently. Accordingly, a swing bolt assembly with a short protrusion is not satisfactory.

Another solution has been to provide a swing bolt that has a number of tapered camming surfaces to facilitate the forcing of the bolt back into its housing as the door is closed. Such a lock bolt is illustrated in U.S. Pat. No. 4,237,711 to Kambic. However, in that bolt the door first contacts the ridge line formed at the intersection of two camming surfaces. As the bolt is forced back into its housing the door traverses the ridge line until it ultimately contacts across the length of the camming surface nearest the pivot point. The door initially contacts only a small point on the ridge line. The pressure exerted on that point is very high and it is difficult therefore to initiate the rotating motion of the bolt.

Once this motion has started the frictional forces drop until the door contacts across the length of the camming surface. If the bevel angle of the camming surface is too low relative to the face of the door, the door may stop.

Thus, there remains a need for a swing bolt which allows enough protrusion to sufficiently engage the receiving plate on the door to hold the door closed, is narrow in width, and which has a steeply angled bevel on the striking face so that it functions efficiently. The angle of incidence between the face of the bolt and the door must be sufficiently steep to allow the door to force the bolt back into its housing as the door closes.

SUMMARY OF THE INVENTION

In accordance with the present invention, a conventional swing bolt lock housing is mounted in a mortise formed in door jamb or frame. The swing bolt that is utilized with the conventional locking mechanism is the subject of this invention. In its resting position (i.e., the locked position), the swing bolt protrudes outwardly from the door jamb. It is pivotally mounted on a shaft located in the lock housing, and a spring or similar device pushes the bolt into its locked position. When the bolt is in the locked position the point farthest from the pivot protrudes further from the jamb than a point closer to the pivot. When utilized in a penal institution the lock of the present invention is typically remotely actuated by pneumatic or electromechanical mechanisms.

In order to allow the door to force the bolt to rotate back into the housing about its pivot point as the door is closed, the bolt is manufactured with two warped surfaces. The bevel angle across the face of the bolt at a point closest to the pivot is much steeper relative to the face of the door than the bevel angle across the bolt at a point further away from the pivot point. Thus, the face of the bolt has a first contact surface having a steeper angle of incidence relative to the edge of the door than the second surface. The first contact surface is located nearer the pivot; the second surface is further from the pivot.

As the door is closed it first strikes the first contact surface across a length of the surface. In this sense the first contact surface forms a leading edge which leads the bolt with respect to the approach path of the door, and the second surface is in effect recessed back from the first contact surface. Because the flatter second surface of the bolt is recessed back from the first contact surface of the bolt, as the bolt rotates back into the housing more of the steep surface of the first contact surface is exposed to the door and the flatter second surface of the bolt always trails and never contacts the door. In this way the door drives the bolt back into the housing without difficulty.

The bevel angle of the first contact surface is steep enough relative to the face of the door that the angle of incidence between the face of the bolt and the edge of the door is sufficiently steep to allow the door to easily drive the bolt back into its housing. As the door closes, it traverses the first contact surface, forcing the bolt back into the housing. Since the door contacts the first contact surface across a length of the surface the force on the bolt is spread out over that length; the resulting frictional force is sufficiently low to allow the door to close completely. Once the door is completely closed the bolt is forced back up into the receiving hole, securing the door in a locked position.

Most importantly, the shape of the face of the bolt in the present invention allows the door to force the bolt back into the housing without interruption, yet allows the bolt to be narrow in width. It thus provides sufficient protrusion from the housing to securely engage doors with wide assembly tolerances which lead to variable reveals. It also allows the bolt and its housing to be narrow in cross-sectional width, thereby decreasing the space and materials needed for mounting the lock. This leads to reductions in the cost of materials needed for preparation of the door jamb and the lock itself.

It is accordingly one object of the present invention to provide an improved method and apparatus for securing doors.

It is another object of the present invention to provide a door securing method and apparatus which has applicability to a wide variety of applications, including the opening and closing of relatively heavy metal doors in penal institutions.

Another object of the present invention is to provide a door locking apparatus which is mountable in a door jamb and which has a narrow cross-sectional depth.

Still another object of the present invention is to provide a door locking apparatus which will be easily driven back into the lock body by the door.

The invention relates to the above features and objects individually as well as collectively. These and other objects of the present invention will become more apparent with reference to the following detailed description and drawings.

DETAILED DESCRIPTION OF A PREFERRED EMBODIMENT

Figure 1:
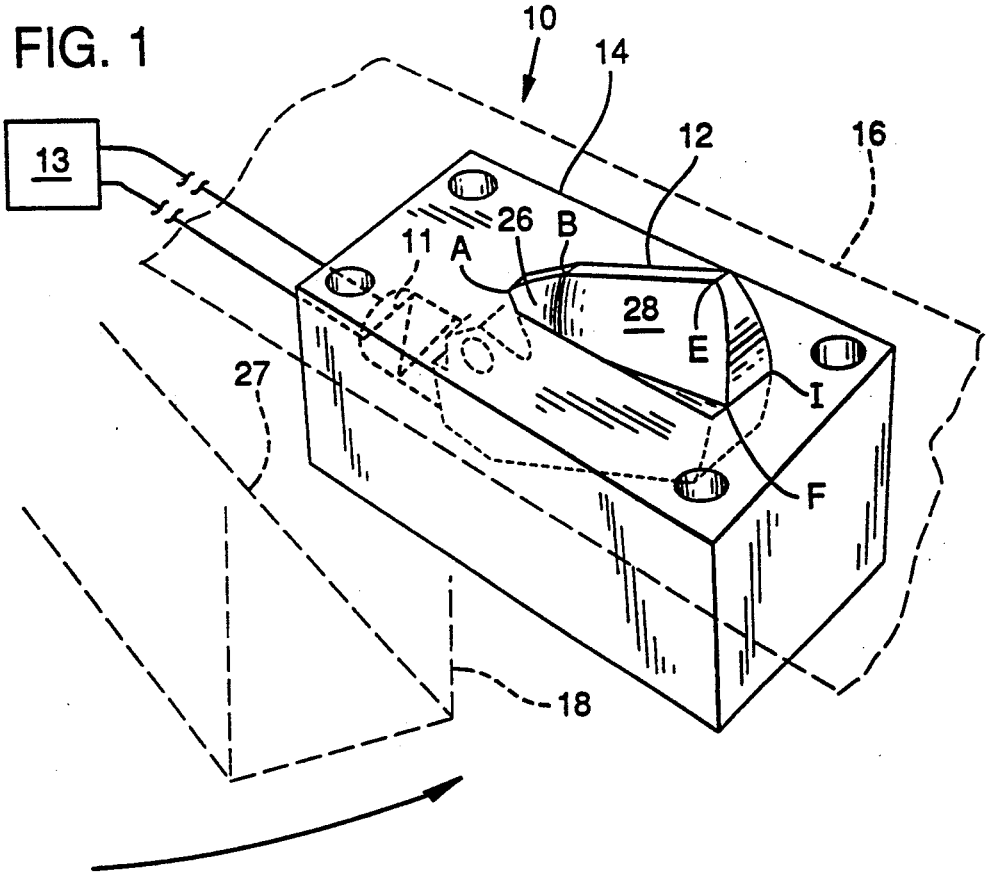
FIG. 1 is a perspective view of a swing bolt made in accordance with the present invention showing the lock housing and part of the jamb in which the housing is mounted.

A lock mechanism including a lock bolt manufactured in accordance with the present invention is illustrated in FIG. 1, and designated generally by the numeral 10. The lock mechanism 10 includes a lock housing 14, and the lock bolt 12 of the present invention. Although not shown, housing 14 contains the lock mechanism itself, which is conventional. Housing 14 is mounted into a mortise 15 formed in door jamb 16. Although the lock mechanism 10 of the present invention is generally mounted in a door jamb, it may also be mounted in the door itself. The mortise 15 may be formed at any location in the door jamb 16. However, it is typically formed on one of the vertical sides of the door jamb. The door is depicted as number 18 in FIG. 1.

Figure 2:
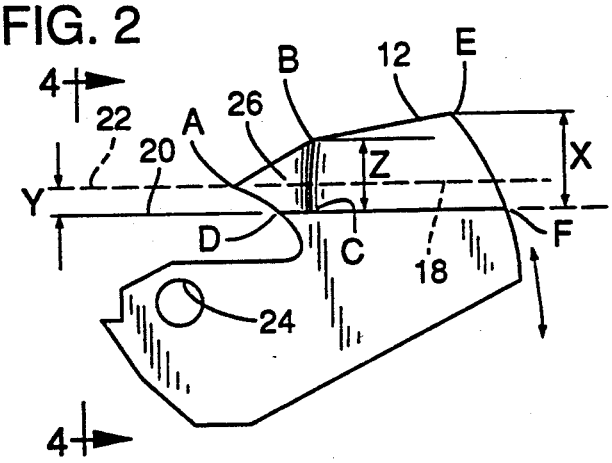
FIG. 2 is a side view of a swing bolt made in accordance with the present invention.

The lock bolt 12 of the present invention is shown in detail in FIG. 2. The door engaging portion of lock bolt 12 extends above the surface 20 of housing 14 by a distance X. In order to sufficiently engage door 18 it is preferred that the door engaging portion of lock bolt 12 protrude above surface 20 a distance X of between 1.90 and 2.54 cm. Of course, as distance X increases, the further the door engaging portion of lock bolt 12 will engage door 18, making for a more secure closure. Furthermore, as distance X increase, it allows for greater variance in the reveal distance, which is denoted by the distance Y in FIG. 2. The reveal distance is the distance between the bottom edge 22 of door 18 and surface 20 of housing 14.

The body of lock bolt 12 includes a mounting aperture 24 through which a pivot pin (not shown) is inserted. The pivot pin is attached to the lock mechanism within housing 14 in a conventional manner. Lock bolt 12 pivots about the pivot pin with respect to the housing 14. A spring 11 is coupled to lock bolt 12 to bias lock bolt 12 in the extended position, as seen in FIG. 1, when the door is open or closed. The spring 11 also allows the door 18 to force lock bolt 12 into the retracted position when door 18 is being closed and the door edge contacts lock bolt 12. The lock mechanism also includes a remote actuating system that releases the door when it is engaged (that is, when it is closed). The remote releasing mechanism 13 is typically a pneumatic or electromagnetic release, as is well known in the art. This part of the device is conventional. When lock bolt 12 is released it rotates back into housing 14 to release the engagement with door 18. Distance Z is essentially zero when lock bolt 12 is in the retracted position. In other words, point B on lock bolt 12 is essentially flush with the surface 20 of housing 14, and point E is below surface 20.

Figure 3:
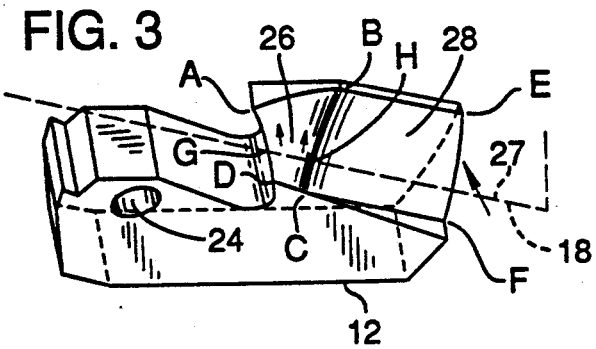
FIG. 3 is a perspective view of the swing bolt shown in FIG. 1.

The door engaging portion of lock bolt 12 is defined by two distinct warped planes. The first warped plane is defined by points A, B, C, D, and may be called for convenience the door contact surface 26. The second warped plane is defined by points B, E, F, C, and is referred to hereinafter as second surface 28. As seen in FIG. 3, initial contact by the leading edge 27 of door 18 is along a line defined by the points G-H on door contact surface 26. Contact line G-H extends across the length of door contact surface 26. The location of contact line G-H on door contact surface 26 will vary with the width of the reveal distance Y. Increasing the reveal distance Y results in the contact line G-H being at a position further away from the surface 20 of housing 14.

As the door 18 closes and leading edge 27 first makes contact along length G-H on door contact surface 26, lock bolt 12 begins to rotate back into the lock housing 14. As door 18 moves toward the closed position and the lock bolt 12 is forced further back into housing 14, the leading edge 27 of door 18 traverses across door contact surface 26. Thus, the contact line G-H between leading edge 27 of door 18 and door contact surface 26, traverses door contact surface 26 from its initial point closest to surface 20 to its uppermost point furthest away from surface 20. The warped shape of door contact surface 26 is cut such that the leading edge 27 of door 18 remains in continuous contact across contact line G-H as door 18 is closed. In other words, as door 18 closes and forces lock bolt 12 into the retracted position, leading edge 27 is at all times substantially parallel to the door contact surface 26 that leading edge 27 contacts, defined as line G-H.

Figure 4:
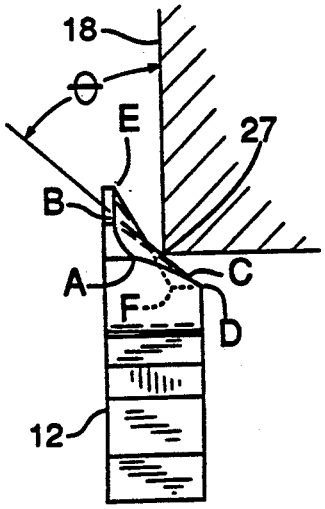
FIG. 4 is a cross-sectional view taken along the line 4—4 of FIG. 2.

As may be seen in FIG. 4, the second surface 28 of lock bolt 12, which is defined by points B, E, F, C, is at all times further away from the leading edge 27 of door 18 than is contact line G-H on door contact surface 26. Thus, second surface 28 is never contacted by the leading edge 27 of door 18. As door 18 is closed, leading edge 27 traverses door contact surface 26, forcing lock bolt 12 into the retracted position in housing 14, until the leading edge 27 reaches the uppermost portion of door contact surface 26, which is defined by the line A-B. At that point, distance Z is essentially equal to the distance of the reveal between the bottom edge 22 of the door and the surface 20 of housing 14. If the reveal distance Y is very small, distance Z is at this point is essentially zero, and point E is below surface 20. Thus, the leading edge 27 of door 18 continues to traverse contact surface 26 until it reaches and traverses line A-B. This allows the door 18 to close completely, at which point the spring means will force lock bolt 12 into its extended position such that it engages the receiving hole in door 18.

In most penal institutions, and most other applications in which a swing bolt would be required, both the door 18 and lock bolt 12 will be constructed of hardened steel. The coefficient of friction for clean steel on steel is 0.8. As seen in FIG. 4, angle $\theta$, which is defined by the angle that the line between points C and B diverges away from the vertical face of the door, must exceed 39 degrees in order for leading edge 27 of door 18 to overcome the normal frictional forces such that it traverses reliably along line G-H of door contact surface 26 (FIGS. 2 and 3). In the preferred embodiment of the present invention angle $\theta$ is at all times approximately 57 degrees. The warping of door contact surface 26 allows this angle of incidence to be maintained at all times as lock bolt 12 is forced into its retracted position. This steep of an angle of incidence between the leading edge 27 of door 18 and door contact surface 26 allows a steel door to slide reliably along the steel lock bolt 12 at normal pressures. This provides for trouble-free and lubricant-free operation.

In addition to the angle of incidence between the leading edge 27 of door 18 and the door contact surface 26 on the lock bolt 12 being greater than 39 degrees, it is also critical that the leading edge 27 of door 18 initially contacts lock bolt 12 along the entire length of door contact surface 26 (that is, along the length G-H). The greater the length G-H, the lower the pressure that is exerted by door 18 along the line G-H. The velocity and mass of the door, the frictional forces on the lock bolt and between the lock bolt and the door, the spring load on the bolt, the inertia of the bolt, and the angle of incidence between the lock bolt and the door all dictate the functional length of line G-H that is necessary to overcome the initial forces caused by impact of the door on the contact surface such that the door will force the lock bolt back into its housing. For example, as the length of line G-H decreases, the amount of pressure exerted on the lock bolt increases since the pressure is spread over a smaller area. This tends to make it more difficult for the initial frictional force to be overcome, with the result that the door may not be able to force the lock bolt back into its housing. If this happens the door may not close. As noted above, as reveal distance Y increases, the distance of line G-H from surface 20 increases. Thus, as may be seen in FIG. 2, as distance Y increases, the length of line G-H increases.

In the preferred embodiment the smallest length of line G-H would be about 6 mm. This would occur when reveal distance Y is near zero so that leading edge 27 of door 18 initially contacts contact surface 26 close to the line defined by D-C. As reveal distance Y increases the length of line G-H also increases up to a maximum of about 13 mm. These distances will of course vary with the specific construction of the lock bolt. It has been found that a minimum length of line G-H that would allow reliable operation would be about 3 mm.

A final feature of lock bolt 12 of the present invention concerns the distance that the first contact surface 26 and the second surface 28 protrude above surface 20 of housing 14. When lock bolt 12 is in its extended position (FIG. 2), point E protrudes a first distance from surface 20 of housing 14. This distance is denoted as distance X. Point B on first contact surface 26 protrudes a second distance above surface 20 of housing 14. This second distance is denoted as distance Z. As lock bolt 12 rotates back into its retracted position (i.e., in a clockwise direction in FIG. 2), both point E and point B begin to approach surface 20. Thus, distance X and distance Z begin to decrease. Point E is on a larger radius than point B since it is farther away from the axis of rotation, which runs through mounting aperture 24. Thus, point E approaches surface 20 at a faster rate than point B. Because the angle of line B-E with respect to surface 20 is smaller than the angle of line A-B with respect to surface 20, the differential between the length of distance X and distance Z will decrease as lock bolt 12 rotates back into housing 14. In other words, as lock bolt 12 rotates back into housing 14, distance X decreases until at some point it equals distance Z. Beyond this point distance Z is greater than distance X. When distance Z is zero, that is, when lock bolt 12 is fully retracted into housing 14, distance X will in essence be negative since point E will be below surface 20.

The result of this construction of lock bolt 12 is that second surface 28 is always behind contact surface 26, with respect to the leading edge 27 of door 18, as lock bolt 12 rotates back into housing 14. Thus, leading edge 27 always contacts contact surface 26, but never contacts second surface 28. When the lock bolt 12 rotates back into housing 14 to the point that distance X equals distance Z, all of second surface 28 is behind contact surface 26 and cannot be contacted by the leading edge 27. The leading edge 27 continues to traverse across surface 26 along line G-H until dropping off along line A-B. Accordingly, the angle given to second surface 28 may be smaller than the angle of door contact surface 26 relative to the leading edge 27 of door 18. This allows for increased protrusion (distance X when lock bolt 12 is in the fully extended position), and also increased width of lock bolt 12 at the area of lock bolt 12 designated by points E, F, I (FIG. 1). The increased width provides greater strength, and the increased protrusion allows greater engagement with door 18.

While the lock bolt of the present invention has been described with in accordance with the preferred embodiment, it is to be understood that certain substitutions and alterations may be made thereto without departing from the spirit and scope of the appended claims.

I claim:

1. A lock bolt movable into a retracted position when displaced by a door edge having a length, the bolt comprising:

a body;

mounting means for mounting the body for rotation about an axis, the body being rotatable within a first plane perpendicular to the axis, the bolt being rotatable about the axis between an extended and a retracted position;

a contact surface formed on the body, the contact surface warped out of a plane, the contact surface being shaped so that the door edge moves along the contact surface to force the bolt from the extended into the retracted position, the contact surface shaped so that the edge of the door continuously contacts the contact surface along a length of the edge as the moving edge contacts the contact surface to force the bolt into the retracted position, and so that the smallest angle defined by the intersection of any plane that is parallel to the first plane with the contact surface is greater than 40 degrees.

2. A lock bolt according to claim 1, wherein the door contacts the contact surface along a length at least 3 mm.

3. A lock bolt according to claim 1, wherein the mounting means includes a spring means for biasing the lock bolt into the extended position.

4. A lock bolt according to claim 1, wherein the mounting means includes release means for moving the bolt from the extended position when the door is closed into the retracted position to release the door so that it may be opened.

5. A lock bolt according to claim 4, wherein the release means is remotely controlled.

6. A lock bolt according to claim 4, wherein the release means comprises a pneumatic control.

7. A lock bolt according to claim 4, wherein the release means comprises an electromagnetic control.

8. A lock bolt movable into a recessed position when displaced by a door edge, the bolt comprising:

a body;

mounting means for mounting the body for rotation about an axis, the bolt being rotatable about the axis between a extended and a retracted position, the body being rotatable within a first plane that is perpendicular to the axis;

a contact surface formed on the body, the contact surface warped out of a plane, the contact surface being shaped so that the smallest angle defined by the intersection of any plane that is parallel to the first plane with the contact surface is greater than 40 degrees, and wherein the door edge continually contacts the contact surface along a length of the surface greater than 3 mm.

9. A lock bolt movable into a recessed position when displaced by a door edge, the bolt comprising:

a body;

mounting means for mounting the body for rotation about an axis between an extended and a retracted position, the body being rotatable within a first plane perpendicular to the axis, the bolt shaped to extend a first distance from a first surface when the bolt is in the extended position;

a contact surface formed on the body, the contact surface warped out of a plane, the contact surface being shaped so that the door edge contacts the contact surface to force the bolt from the extended into the recessed position, the contact surface extending no further than a second distance from the first surface when the bolt is in the extended position, the second distance being less than the first distance, and wherein the door edge continuously contacts the contact surface across a length of the surface greater than 3 mm, and the smallest angle defined by the intersection of any second plane that is parallel to the first plane with the contact surface is greater than 40 degrees.

* * * * *